US010252293B2

(12) United States Patent
Bischofberger et al.

(10) Patent No.: US 10,252,293 B2
(45) Date of Patent: Apr. 9, 2019

(54) METHOD FOR COATING COOLING CHANNEL WITH COATING CONTAINING HEXAGONAL BORON NITRIDE

(71) Applicant: Mahle International GmbH, Stuttgart (DE)

(72) Inventors: Ulrich Bischofberger, Esslingen (DE); Stephan Koerner, Besigheim (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/735,464

(22) PCT Filed: Jun. 10, 2016

(86) PCT No.: PCT/EP2016/063324

§ 371 (c)(1),
(2) Date: Dec. 11, 2017

(87) PCT Pub. No.: WO2016/198618

PCT Pub. Date: Dec. 15, 2016

(65) Prior Publication Data

US 2018/0163310 A1 Jun. 14, 2018

(30) Foreign Application Priority Data

Jun. 12, 2015 (DE) ..... 10 2015 007 334

(51) Int. Cl.
*B05D 7/22* (2006.01)
*F02F 3/22* (2006.01)
*C23C 24/08* (2006.01)

(52) U.S. Cl.
CPC ..... *B05D 7/22* (2013.01); *C23C 24/08* (2013.01); *F02F 3/22* (2013.01); *F02F 3/225* (2013.01)

(58) Field of Classification Search
CPC ..... F02F 3/22; B05D 7/22
USPC ..... 427/230
See application file for complete search history.

(56) References Cited

U.S. PATENT DOCUMENTS

2013/0014723 A1* 1/2013 Bucher ..... B23K 35/224 123/193.6
2014/0272188 A1 9/2014 Rose et al.

FOREIGN PATENT DOCUMENTS

DE 102008020906 A1 10/2009
DE 102011107659 A1 1/2013
DE 102012025283 A1 6/2014
EP 2096290 A1 9/2009

OTHER PUBLICATIONS

English abstract for DE-102012025283.
English abstract for DE-102008020906.

* cited by examiner

*Primary Examiner* — William P Fletcher, III
(74) *Attorney, Agent, or Firm* — Fishman Stewart PLLC

(57) ABSTRACT

A method for coating a surface of a closed cooling channel, having a plurality of oil supply bores and a plurality of oil discharge bores, of a piston for an internal combustion engine, having a coating medium containing hexagonal boron nitride may include introducing a defined quantity of a coating medium comprising a suspension of hexagonal boron nitride with a solution on a basis of at least one thermally curable inorganic binder and at least one solvent into the cooling channel, spreading the coating medium over the surface of the cooling channel by moving the piston about at least two spatial axes, using a laminar air flow to dry the coating medium spread over the surface of the cooling channel, and thermally curing the coating medium to complete a coating adhering to the surface of the cooling channel.

19 Claims, 2 Drawing Sheets

METHOD FOR COATING COOLING CHANNEL WITH COATING CONTAINING HEXAGONAL BORON NITRIDE

CROSS-REFERENCE TO RELATED APPLICATIONS

This application claims priority to PCT/EP2016/063324 filed on Jun. 10, 2016 and German Patent Application No.: DE 10 2015 007 334.6 filed on Jun. 12, 2015, the contents of both are incorporated herein by reference in their entireties.

TECHNICAL FIELD

The present invention relates to a method for coating the surface of a closed cooling channel, having oil supply bores and oil discharge bores, of a piston for an internal combustion engine, having a coating medium containing hexagonal boron nitride. The present invention further relates to a piston that can be produced by such a method.

Pistons coated in this way are known. Cooling channel pistons are preferably used in modern internal combustion engines having high specific engine power since, in comparison to pistons cooled merely by impingement spraying, they can remove a greater quantity of heat during engine operation, and thus their maximum operating temperature can be markedly reduced.

However, this concept proves to be problematic in the most recent engine designs with even higher specific engine power. Even after short engine running times, strongly adhering oil carbon deposits form in the hottest regions of the piston, in particular in the cooling channel. Deposits of this kind also have thermally insulating properties, which impedes the dissipation of heat. As a consequence, the temperature of the piston rises disproportionately during engine operation. In the case of steel pistons, this also leads to increased scale formation. In extreme cases, these pistons become so hot that irreversible degeneration of the steel material sets in. If the engine continues to operate, this leads to cracks in the steel material and, subsequently, to complete failure of the piston function.

EP 2 096 290 A1 discloses a fluorosilane-based anti-adhesion coating.

BACKGROUND

DE 10 2008 020 906 A1 discloses a protective coating for devices and industry. This protective coating comprises a polymer-based matrix, in particular a polysiloxane, in which are embedded particles, in particular of hexagonal boron nitride. Coatings of this kind have, inter alia, excellent non-wetting properties in order to prevent deposits of thermally insulating solids such as ash or clinker.

It has been found that the coatings known up to now are either very laborious to apply and produce coatings with an uneven layer thickness, thus giving rise to at least localized thermal barrier effects which hinder the flow of heat out of the cooling channel. In particular, the entire surface of a cooling channel cannot be coated with satisfactory results.

SUMMARY

The present invention has the object of further developing a generic method such that it is possible to obtain an evenly thin coating over the entire surface of the cooling channel.

The solution is to be found in a method having the following method steps: a) introducing, into the cooling channel, a defined quantity of a coating medium in the form of a suspension of hexagonal boron nitride with a solution on the basis of at least one thermally curable inorganic binder and at least one solvent; b) spreading the coating medium over the surface of the cooling channel by moving the piston about at least two spatial axes; c) using a laminar air flow to dry the coating medium spread over the surface of the cooling channel; d) thermally curing the coating medium to complete a coating adhering to the surface of the cooling channel.

The method according to the invention is characterized in that it is possible to produce a piston in which the entire surface of the cooling channel is provided with a coating containing hexagonal boron nitride, which coating has an even thickness over the entire surface of the cooling channel, preferably of between 10 μm and 100 μm. As a result of this, the passage of heat out of the cooling channel is hindered only slightly, if at all.

Advantageous developments can be found in the dependent claims.

Expediently, prior to step a) the size of the surface of the cooling channel is determined in order to be able to optimally dose the coating medium. If the cooling channel has a surface area of 190 $cm^2$, an optimal dose is 7 ml, that is to say approximately 36.84 μl per square centimeter.

Preferably, prior to step a) the surface of the cooling channel is cleaned with a cleaning substance in order to improve the adhesion of the coating on the surface. Suitable cleaning substances are for example methanol, ethanol, acetone, 1-propanol and 2-propanol, and other short-chain alcohols.

The coating medium used in step a) contains, as preferred binder, at least one polysiloxane, which is preferably dissolved in ethanol.

As further binder, use can be made of sodium silicate and/or potassium silicate, it being thus possible to use a sol-gel method.

In step b) the piston can be moved for example by means of a biaxial mixing device. Biaxial mixing devices are known per se and are generally used for mixing paints and pigments.

Preferably, in step c) a laminar air flow with a velocity of 1 to 2 meters per second is used, in order to avoid the coating medium being unevenly distributed over the surface of the cooling channel by an excessively rapid air flow. The cooling of the coating medium takes place expediently at room temperature.

In step d) the thermal curing can be carried out for example at a temperature of 180° C. to 220° C.

There follows a more detailed description of an exemplary embodiment of the present invention, with reference to the appended drawing. In a schematic and not-to-scale representation,

DETAILED DESCRIPTION

Figure 1:
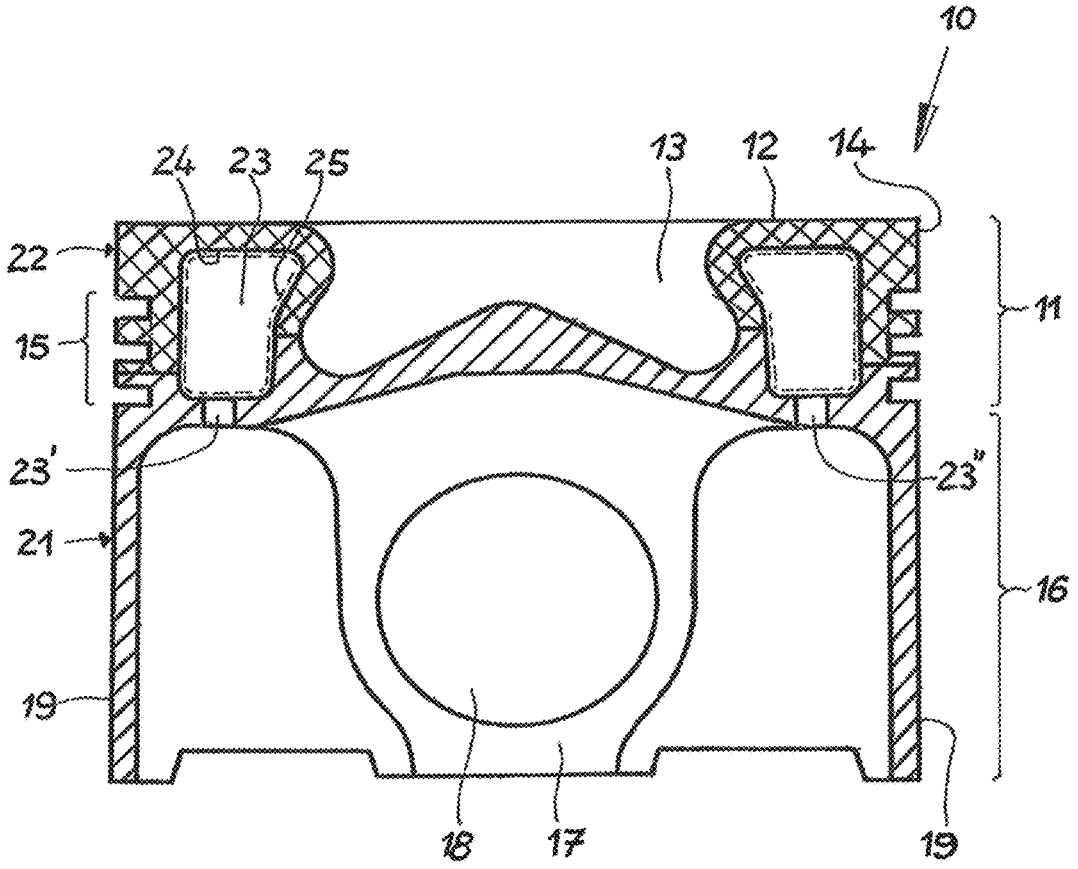
FIG. 1 shows, in section, an exemplary embodiment of a piston according to the invention.

The piston 10 has a piston head 11 with a piston crown 12, a combustion depression 13, a circumferential fire land 14 and a circumferential ring portion 15 with ring grooves for receiving piston rings (not shown).

The piston 10 also has a piston skirt 16 which is provided, in a manner known per se, with piston bosses 17 in which are created boss bores 18 for receiving a piston pin (not shown). The piston bosses 17 are connected to one another by running surfaces 19.

In the exemplary embodiment, the piston 10 is designed as a one-piece piston made of a steel material. In this context, a piston main body 21 and a piston upper part 22 are permanently connected to one another by welding or soldering. The piston main body 21 and the piston upper part 22 can be made of the same material or of different materials.

The piston main body 21 and the piston upper part 22 together form a cooling channel 23 that is circumferential at the level of the ring portion 15, which channel has oil supply bores and oil discharge bores 23', 23". The surface 24 of the cooling channel 23 is provided with a coating 25 containing hexagonal boron nitride (hBN). The thickness of the coating 25 is preferably 20 μm to 40 μm. The thermal conductivity of the coating 25 is preferably 40 W/mK to 50 W/mK, depending on the degree of purity of the hexagonal boron nitride. The coefficient of friction of the coating 25 is constant up to a temperature of 600° C. and is 0.2. The specific surface area of the coating 25, depending on the degree of purity of the hexagonal boron nitride, is 5 $m^2/g$ to 15 $m^2/g$.

There follows a description of an exemplary embodiment of the method according to the invention for coating the cooling channel 23.

First, the surface area of the cooling channel 23 in $cm^2$ is determined in order to be able to optimally dose the coating medium.

The surface 24 of the cooling channel 23 is thoroughly cleaned with ethanol. To that end, depending on the size of the surface 24, 10 ml to 30 ml of ethanol are introduced into the cooling channel 23 via one of the oil supply or oil discharge bores 23', 23", and the bores 23', 23" are closed with stoppers (preferably made of a rubber-elastic material). The piston 10 is moved in order to spread the ethanol inside the cooling channel and to ensure that the entire surface 24 is wetted with ethanol. For this, use can be made for example of a biaxial mixer. Then, the stoppers are removed so that the remaining ethanol runs out of the cooling channel 23. The surface 24 of the cooling channel 23 is dried via one of the bores 23', 23" using a laminar air flow having a flow velocity of 1 m/s to 2 m/s for five minutes at room temperature.

As coating medium, use is made of a suspension of particles of hexagonal boron nitride in a polysiloxane dissolved in ethanol. In the exemplary embodiment, the content of hexagonal boron nitride in the suspension is 104 g/l, based on the volume of the pure polysiloxane solution. In the exemplary embodiment, the polysiloxane content is 61 g/l, based on the total volume of the suspension. In the exemplary embodiment, the ethanol content of the suspension is 647 g/l, based on the total volume of the suspension. A coating medium of that type is commercially available, for example under the name HeBoCoat®400E from the manufacturer Henze Boron Nitride Products AG, Grundweg 1, 87493 Lauben. It is essential that the coating medium be free from halogen-containing substances, in particular free from fluorine-containing substances.

Dosing is related to the size of the surface 24 of the cooling channel 23 in $cm^2$. Optimal dosing of the suspension is 7 ml for a surface 24 of the cooling channel 23 with an area of 190 $cm^2$. This corresponds, in the exemplary embodiment, to 4.53 g of ethanol, 0.43 g of polysiloxane and 0.73 g of hBN.

Figure 3:
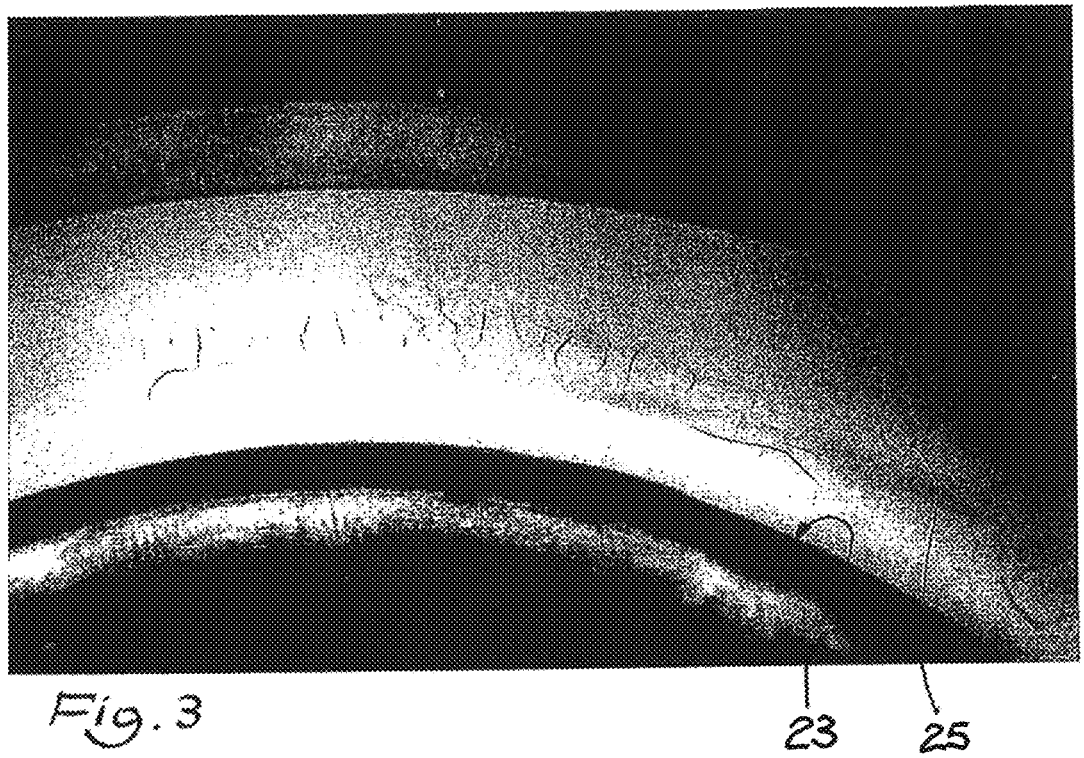
FIG. 3 shows a further photographic representation of the main body of a piston, with a defective coating.
Figure 2:
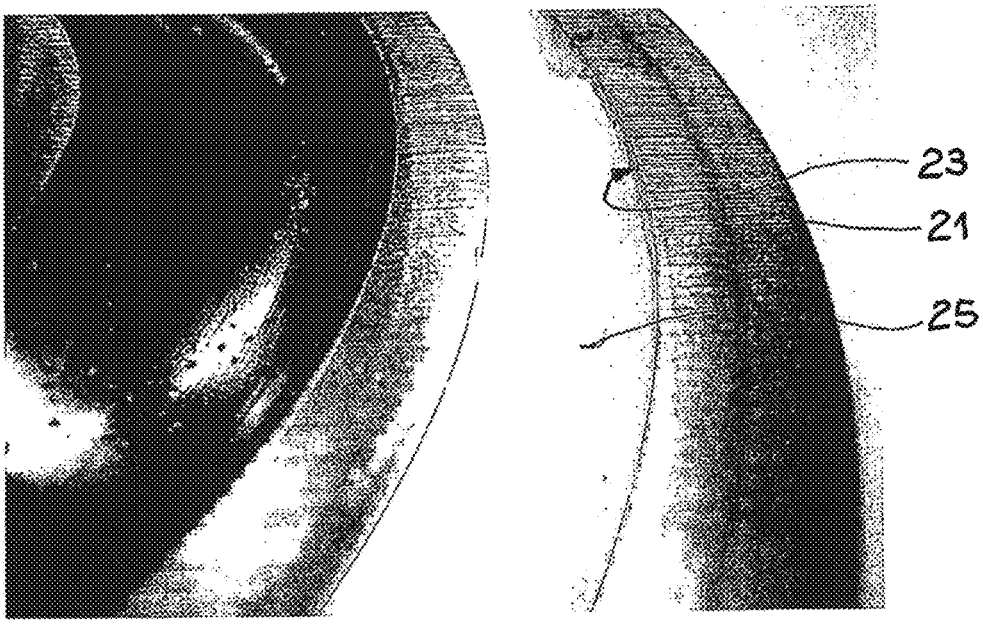
FIG. 2 shows a photographic representation of the main body of a piston as per FIG. 1, with the coating that has been applied using the method according to the invention.

A test with various doses of the coating medium for a cooling channel 23 having a surface 24 with an area of 190 $cm^2$ yielded the following results, the results of the optimal dose and the excessive dose being illustrated in FIGS. 2 and 3:

| | Optimal dose 7 ml/190 $cm^2$ (FIG. 2) | Excessive dose 10 ml/190 $cm^2$ (FIG. 3) | Insufficient dose 4-5 ml/190 $cm^2$ |
|---|---|---|---|
| Layer thickness of the coating (25) | 20 to 40 | 160 to 170 | No coating in places |
| Layer adhesion after drying | Very good layer adhesion, | Layer spalling and marked crack | No crack formation |
| Drying behavior | Even drying behavior | Suspension gathers locally at the edges, crack formation there | Very good drying properties |
| Flow behavior in the cooling channel | Suspension spreads evenly, even layer thickness | Excess suspension runs back out via oil discharge bore 23' or 23" | Suspension reaches only some regions of the cooling channel 23 |

The coating medium is introduced into the cooling channel 23 via one of the bores 23', 23", expediently with the aid of a dosing device, for example a metering pump. The bores 23', 23" are closed with stoppers, preferably made of a rubber-elastic material.

Then, the piston 10 is moved about at least two spatial axes. This motion is essential for spreading the coating medium evenly over the surface 24 of the cooling channel. This is expediently done using a rotation unit, for example a biaxial mixer that is known per se, with which the piston 10 is rotated both about its longitudinal axis and also about an axis running perpendicular to the longitudinal axis.

Then, the stoppers are removed. The coating medium adhering to the surface 24 of the cooling channel 23 is dried via one of the bores 23', 23" using a laminar air flow having a flow velocity of 1 m/s to 2 m/s for approximately five minutes at room temperature (approximately 20° C.). This removes the ethanol from the coating medium. This drying step is essential in order to ensure defect-free, even drying of the coating medium. The flow velocity of the laminar air flow may not be too high as this could cause coating medium adhering to the surface 24 of the cooling channel 23 in the vicinity of the bores 23', 23" to be displaced by the air pressure, which would result in a coating having an uneven thickness.

Curing by heat treatment is used to produce the finished coating 25, in which the piston 10 is heated to 180° C. to 220° C. for a period of 25 min to 60 min. In this context, the polysiloxane is converted, in a manner known per se, to a $SiO_2$ matrix in which the particles of hexagonal boron nitride are embedded.

The resulting coating 25 has a surface energy of 15-17 mN/m and a layer thickness of 20 μm to 40 μm, which is constant over the entire surface 24 of the cooling channel 23. Owing to its small layer thickness, the coating 25 has no thermally insulating effect on the material of the piston 10. The coating 25 is heat-resistant up to 600° C.

The invention claimed is:

1. A method for coating a surface of a closed cooling channel, having a plurality of oil supply bores and a plurality of oil discharge bores, of a piston for an internal combustion engine, comprising:

a) introducing a defined quantity of a coating medium including a suspension of hexagonal boron nitride with a solution including at least one thermally curable inorganic binder and at least one solvent into the cooling channel;

b) spreading the coating medium over the surface of the cooling channel by moving the piston about at least two spatial axes;

c) using a laminar air flow to dry the coating medium spread over the surface of the cooling channel; and d) thermally curing the coating medium to complete a coating adhering to the surface of the cooling channel.

2. The method as claimed in claim 1, wherein prior to step a) a size of the surface of the cooling channel is determined.

3. The method as claimed in claim 1, wherein prior to step a) the surface of the cooling channel is cleaned with a cleaning substance.

4. The method as claimed in claim 3, wherein the cleaning substance includes one or more of methanol, ethanol, acetone, 1-propanol, and 2-propanol.

5. The method as claimed in claim 1, wherein in step a) at least one polysiloxane is used as the at least one thermally curable inorganic binder.

6. The method as claimed in claim 5, wherein ethanol is used as the at least one solvent.

7. The method as claimed in claim 1, wherein at least one of sodium silicate and potassium silicate is used as an additional binder.

8. The method as claimed in claim 1, wherein in step a) a quantity of 7 ml of the coating medium is used to coat the surface of the cooling channel per 190 $cm^2$ of area.

9. The method as claimed in claim 1, wherein in step b) the piston is moved via a biaxial mixing device.

10. The method as claimed in claim 1, wherein in step c) the laminar air flow has a velocity of 1 to 2 meters per second.

11. The method as claimed in claim 1, wherein in step c) drying is carried out at room temperature.

12. The method as claimed in claim 1, wherein in step d) the thermal curing is carried out at a temperature of 180° C. to 220° C.

13. The method as claimed in claim 1, wherein the coating has a substantially uniform thickness over an entire surface of the cooling channel.

14. The method as claimed in claim 1, wherein the coating has a thickness of between 10 μm and 100 μm.

15. The method as claimed in claim 1, wherein a thickness of the coating is between 20 μm to 40 μm.

16. The method as claimed in claim 1, wherein a thermal conductivity of the coating is 40 W/mK to 50 W/mK.

17. The method as claimed in claim 1, wherein a coefficient of friction of the coating is 0.2 and is constant up to a temperature of 600° C.

18. The method as claimed in claim 1, wherein a surface area of the coating is 5 $m^2/g$ to 15 $m^2/g$.

19. The method as claimed in claim 1, wherein the piston comprises steel.

* * * * *